US005950961A

United States Patent [19]

Duck

[11] Patent Number: 5,950,961

[45] **Date of Patent: *Sep. 14, 1999**

[54] SPRING ACTUATED, PAPER TOWEL HOLDING AND DISPENSING APPARATUS

[76] Inventor: Patrick Duck, 8732 Edmonston Rd., College Park, Md. 20740

[ * ] Notice: This patent is subject to a terminal disclaimer.

[21] Appl. No.: 09/201,361

[22] Filed: Nov. 30, 1998

Related U.S. Application Data

[63] Continuation-in-part of application No. 09/024,035, Feb. 16, 1998, Pat. No. 5,878,976.

[51] Int. Cl.[6] ..... B65H 16/06

[52] U.S. Cl. ..... 242/596.1; 242/423.1; 242/596.6

[58] Field of Search ..... 242/596.1, 596.7, 242/596.3, 596.6, 423.1, 423.2

[56] References Cited

U.S. PATENT DOCUMENTS 2,021,417 11/1935 Hoffman .
3,034,738 5/1962 Kuhn .
3,088,686 5/1963 Curry .
4,105,168 8/1978 Rutherford .

FOREIGN PATENT DOCUMENTS 350786 1/1990 European Pat. Off. .
1301030 8/1969 Germany .

*Primary Examiner*—Donald P. Walsh
*Assistant Examiner*—William A. Rivera
*Attorney, Agent, or Firm*—John D. Gugliotta

[57] ABSTRACT

A spring actuated, paper towel holding and dispensing apparatus is provided, which functions to provide adjustable and constant pressure to paper towels by utilizing a main body which slidably engages two support arms, with lateral tension being provided by a set of spring members which runs inside the main body and connects the support arms. Such lateral force permits lateral adjustment of the device to fit a variety of paper towels of differing lateral widths. The paper towel roll is secured to the device by a tension adjustment assembly, which provides constant, even, adjustable lateral tension to the paper towel roll itself, and not the paper towels.

4 Claims, 15 Drawing Sheets

SPRING ACTUATED, PAPER TOWEL HOLDING AND DISPENSING APPARATUS

RELATED APPLICATIONS

The present invention is a continuation in part of the application Ser. No. 09/024,035, filed on Feb. 16, 1998 now U.S. Pat. No. 5,878,976.

BACKGROUND OF THE INVENTION

1. Field of the Invention

The present invention relates generally to dispensing apparatus for rolled material, more particularly, to a spring actuated, paper towel holding and dispensing apparatus.

2. Description of the Related Art

As is well-known in the art, numerous devices exist which simplify the process of holding and dispensing of rolled materials, such as bathroom tissue and paper towels. It is also well known that when rolled materials are dispensed, certain problems are routinely encountered. These include the following.

The first problem with the previous art devices is the unintentional disconnection of the paper towel roll from the support and dispensing device. This is due to the structure of many paper towel holding and dispensing apparatus. Many designs include a pair of support arms which extend outward, perpendicular from a base support. These arms normally contain cylindrical shafts mounted horizontally to the arms, upon which the open ends of the paper towel roll are inserted. Others incorporate a spindle placed through the paper towel roll and which connects to both support arms. The paper towel roll is attached to the paper towel holder by pulling the support arms outward, away from the ends of the paper towel roll, such that the paper towel roll can be inserted over the protruding cylindrical shaft, or in the case of devices with spindles, the spindle can be connected to both cylindrical shafts. This outward movement of the support arms flexes the base support, placing significant pressure on it, and over time, deforming the base support. In fact, the pressure on the base support is intentional, as it creates a means of creating the lateral force required between the support arms and the paper towel roll to keep the paper towel roll in place. This deformation of the base support reduces the lateral force that the support arms can exert on the ends of the paper towel roll, or the spindle, thus allowing the paper towel roll to detach from the assembly, most likely during the dispensing of the paper towels.

Some rolled material holding and dispensing devices attempt to solve this deformation problem by utilizing a spring loaded spindle that connects to both support arms. Examples of this technology as applied to toilet paper dispensers, include U.S. Pat. No. 5,374,008, issued in the name of Halvorson et. al., U.S. Pat. No. 3,362,653, issued in the name of Carlisle, U.S. Pat. No. 2,801,809, issued in the name of Glaner, U.S. Design Pat. No. D347,534, issued in the name of Gottselig. Other devices, such as that disclosed in U.S. Pat. No. 5,292,083, issued in the name of Ridenour, utilize a spring, without a spindle, that slides into the paper towel roll cardboard core, to apply the lateral force upon the support arms.

There are, however, problems with applying this type of technology to paper towel holding and dispensing devices. First, these devices and others that utilize the spring loaded spindle are usually used in conjunction with metal dispensers. The base support of these devices can withstand the pressure that the spindle places on the support arms without deforming. Paper towel holders, however, are usually plastic in design, and as such, the pressure placed on the base support from the spring loaded spindle will cause the deformation of the base support and subsequent detachment of the paper towel roll, as discussed above in relation to typical rolled paper dispensers. Thus, plastic paper towel holders with spring loaded spindles are problematic. Second, the metal assemblies, necessary for the adequate function of the spring loaded spindle, are prohibitively heavy, as many paper towel holders are mounted on counter tops without wooden wall supports to be connected to. As such, the metal devices would detach from the drywall, and cause aesthetic damage to the wall. Furthermore, the use of metal in the fabrication of paper towel holders creates several other problems, including increased cost, and increased difficulty of manufacture.

Another problem with spindles is that the use of spindles as a means of attaching the rolled paper to the dispensing assembly is burdensome. The spindle must be removed and reinserted into a new paper towel roll each time one runs out of paper towels, and the spindle must then be connected to the support arms with the bulky paper towel roll obstructing one's view and limited hand space to connect the spindle and the support arms. Also, the spindles typically fall out of the paper towel roll cardboard core during attachment and detachment of the paper towel roll, creating frustration for the user. Second, the spindles fall to the ground and disassemble when the support arms fail to support the paper towel roll during dispensing. Also, upon detachment, the spindle is likely to get lost, even if temporarily, thus adding to frustration of the user. Fourth, the fact that many of the springs are not secured within the spindle housing means that these components will likely spill out even when the roll is purposefully being detached, as during roll changes.

U.S. Pat. No. 4,535,947, issued in the name of Hidle, attempts to deal with the disconnection problem another way. The '947 device discloses support cylinders which are inserted into the roll of paper towels, increasing the axial penetration of the cylindrical shafts, and which connect to the support arms, thus keeping the roll from disconnecting. There are problems with this design, however. First, removing the support cylinders from a used device is time consuming and burdensome. Second, the overall design is complicated. Third, the device does not address the other problems discussed below.

Another problem associated with the dispensing of rolled paper products is the inability to control the exact amount of paper to be dispensed in an easy manner. This problem is due to the fact that most paper towel holders offer too much or too little resistance to the rolling action of the paper towel roll.

Devices which attempt to deal with this problem have generally been of the type disclosed in U.S. Pat. No. 4,239,163, issued in the name of Christian. The '163 device discloses a tissue roll holder brake member insertable to fit snugly into an open end of a cardboard tube on which a roll of tissue paper is wound. The '163 device also employs a spring loaded spindle, which creates the deformation problems when applied to plastic paper towel dispensers, discussed above. As such, the '163 device cannot be adapted to work effectively on paper towel dispensing apparatus.

Some devices rely on the flexing of the support arms and rear main support to place pressure on the paper towel roll. These devices suffer from the deformation problems discussed above. Also, the devices do not place pressure primarily against the cardboard roll that holds the paper towels, but instead, place what little pressure they do create, on the entire paper towel roll. Typically, the entire ends of the paper towel roll rest against the support arms. This configuration gives much resistance when the paper towel roll is full, and the paper towel roll is in contact with a large surface area of the support arms, but offers little resistance when the paper towel roll is near empty. Thus, it is too difficult to turn the paper towel roll when it is full, and too much paper comes off the paper towel roll when it is nearly empty.

In addition, too much pressure on the paper towel roll will likely result in a detachment of the paper towel roll from the device, as the additional force required to tear a sheet of paper towel will likely disconnect the paper towel roll from its point of attachment.

Another problem with devices in the previous art relates to their inability to accommodate paper towel rolls whose widths differ. Different brands of paper towels utilize paper towel roll cardboard cores of differing lengths, and paper towels of differing widths. Because the support arms of these devices are at a fixed distance apart from each other, they cannot adapt to these variations. Paper towel rolls of decreased width cause the roll to detach, while rolls of increased width cause the base support deformation problems discussed above.

Support for the proposition that no one device has solved all these problems and been adopted by the majority of the public, is the fact that no such device exists in the homes of most people.

A search of the previous art did not disclose any patents that read directly on the claims of the instant invention.

Consequently, a need has been felt for providing a simple and economical paper towel holding and dispensing device which overcomes the problems associated with the previous art.

SUMMARY OF THE INVENTION

It is therefore a general object of the present invention to provide an improved, spring activated, paper towel holding and dispensing apparatus that is effective, simple and easy to use, and facilitates the controlled dispensing of paper towels.

In accordance with a preferred embodiment of the present invention, a spring actuated, paper towel holding and dispensing apparatus is disclosed, consisting of a base support, attachment holes, base support male projections, support arm receiving orifices, support arms, cylindrical shafts, spring members, spring member guides, spring member guide holes, spring member retaining orifices, spring member alignment protrusions, base support retention means, flanges, and tension adjustment assemblies.

The base support is longitudinally elongated, and is constructed of a durable, lightweight material, such as plastic. Positioned in lateral linear alignment on the base support are two attachment holes, which can be used in conjunction with an attachment means, such as screws, to attach the present invention to a wall, underneath a cabinet, etc. The base support extends outward and terminates on either end with a base support male projection. The base support male projections are tapered in design. Each of the two base support male projections passes into and terminates inside of a support arm receiving orifice. Attached to the end of each support arm receiving orifice is a support arm. Each support arm is elongated and extends outward, perpendicular to the centerline of the base support. Connected to the interior surface of each support arm, opposite the support arm receiving orifice, is a cylindrical shaft. Each cylindrical shaft is mounted such that its center line is perpendicular to the interior planar surface of each support arm and parallel to the centerline of the base support.

Spring members are positioned within the base support. The one or two spring members extend laterally, running parallel to the center line of the base support, which is hollow in design. Each spring member is positioned in the same plane relative to the centerline of the base support. In the case of two spring members, each spring member passes through the center of the base support, being kept equidistant from each other by means of a spring member guide.

The spring member guide consists of two spring guide member holes positioned in linear alignment. The spring member guide is positioned at the end of each base support male projection. Each spring member passes through the hollow base support male projection and through a spring member guide hole. Each spring member attaches to the support arm by means of a spring member retaining orifice, which is positioned on the exterior surface of a spring member alignment protrusion. The spring member alignment protrusions are cylindrical in shape, and are positioned on the interior surface of the support arm receiving orifice, extending laterally outward, toward the base support. Each spring member alignment protrusion is in linear alignment with the corresponding spring member.

When each base support male projection is inserted into the corresponding support arm receiving orifice, each of the two spring member alignment protrusions is inserted into the corresponding spring member guide hole. A base support retention means, such as a raised wedge, is positioned on the rear interior surface of the support arm receiving orifice. The base support retention means is positioned such that it increases in thickness as its depth into the support arm receiving orifice increases. Once the spring member guide slides over the base support retention means, its lateral movement is limited such that the base support male projection cannot exit from the support arm receiving orifice. Once the base support and the support arm receiving orifice are connected, the relative position of each support arm with respect to the base support can be varied such that the lateral distance between the support arms can be adjusted to fit a variety of paper towel rolls of differing widths.

Each cylindrical shaft contains a flange at the position where the paper towel roll cardboard core contacts the cylindrical shaft. The flange permits the cylindrical shafts to come in contact primarily with the paper towel roll cardboard core, and not the sheets of paper towels. This creates even tension regardless of the amount of paper towels on the paper towel roll.

Lateral force is also applied to the paper towel roll by an inner spring that rests within the cylindrical shaft. Retraction of the cylindrical shaft away from the paper towel roll is facilitated by a retraction means.

To use the device one separates the support arms by pulling them apart. The paper towel roll is then placed in between the support arms, and the paper towel roll cardboard core is place over the cylindrical shafts. The separation of the two support arms elongates the two spring members, which places sufficient, even, lateral forces on the paper towel roll cardboard core when the support arms are released. The paper towel roll will turn slowly and evenly, permitting the easy tearing of the desired number of towels, with one hand, without the paper towel roll becoming disconnected from the cylindrical shafts.

It is another object of the present invention to provide a spring actuated, paper towel holding and dispensing apparatus that successfully addresses the problem of the paper towel roll accidentally detaching from the present invention when the paper towel roll is being turned or when a paper towel is being torn off the paper towel roll.

It is another object of the present invention to provide a paper towel holding and dispensing apparatus that can be used with all brands of paper towels, regardless of minor variations in paper towel width.

It is another object of the present invention to provide a spring actuated, paper towel holding and dispensing apparatus that applies an even resistance to the rolling action of the paper towel roll. Thus, the present invention facilitates the release of precisely the number of sheets the user wishes, without excess paper towels coming off the paper towel roll or without excessive force being required to remove the paper towels from the paper towel roll. Thus, an advantage of the present invention is that it can be operated with one hand.

It is another object of the present invention to provide a spring actuated, paper towel holding and dispensing apparatus that applies pressure to the paper towel roll cardboard core without the paper towels rubbing against the support arms. This creates the advantage of controlled, sufficient pressure applied to the paper towel roll both when the paper towel roll is full and almost empty.

It is another object of the present invention to provide a device which does not require the use of a detachable spindle to hold the paper towel on the device. This creates several advantages. First, no spindle need be inserted into the paper towel core of the rolled paper towels, saving time and effort. Second, there is no spindle to lose, or springs inside the spindle to misplace.

It is another object of the present invention to provide a device that applies sufficient lateral force on the paper towel roll cardboard core without flexing the support arms outward from the paper towel roll and consequently, flexing and compromising the structural integrity of the main support over time.

It is another object of the present invention to provide a device that facilitates the quick and easy installation and removal of paper towel rolls.

It is another object of the present invention to provide a device that is simple in construction, inexpensive to manufacture, and ruggedly constructed.

Yet another object of the present invention is to provide a device that is made from a strong substance, such as plastic, and which parts can be attractively colored for consumer appeal.

It is another object of the present invention to provide a spring actuated, paper towel holding and dispensing apparatus that can be utilized in kitchens, laundry rooms, basements, garages, bathrooms, and any other place it is required.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| | |
|---|---|
| 10 | spring actuated, paper towel holding and dispensing apparatus |
| 20 | base support |
| 30 | attachment hole |
| 35 | attachment means |
| 40 | base support male projection |
| 50 | support arm receiving orifice |
| 60 | support arm |
| 70 | cylindrical shaft |
| 80 | spring member |
| 90 | spring member guide |
| 100 | spring member guide hole |
| 110 | spring member retaining orifice |
| 120 | spring member alignment protrusion |
| 130 | base support retention means |
| 140 | paper towel roll |
| 150 | flange |
| 160 | paper towel roll cardboard core |
| 170 | paper towel |
| 180 | tension adjustment assembly |
| 190 | retaining ring |
| 210 | cylindrical shaft retaining ridge |
| 240 | retaining notch |
| 260 | tension adjustment means |
| 290 | internal spring |
| 300 | internal spring housing |
| 310 | retention means hole |
| 320 | retention means |
| 330 | grasping means |
| 340 | retention means body |
| 350 | cross brace |

DESCRIPTION OF THE PREFERRED EMBODIMENTS

In order to describe the complete relationship of the invention, it is essential that some description be given to the manner and practice of functional utility and description of a spring actuated, paper towel holding and dispensing apparatus 10.

The best mode for carrying out the invention is presented in terms of its preferred embodiments, herein depicted within the FIGS. 1 through 10.

1. Detailed Description of the Figures

Figure 1:
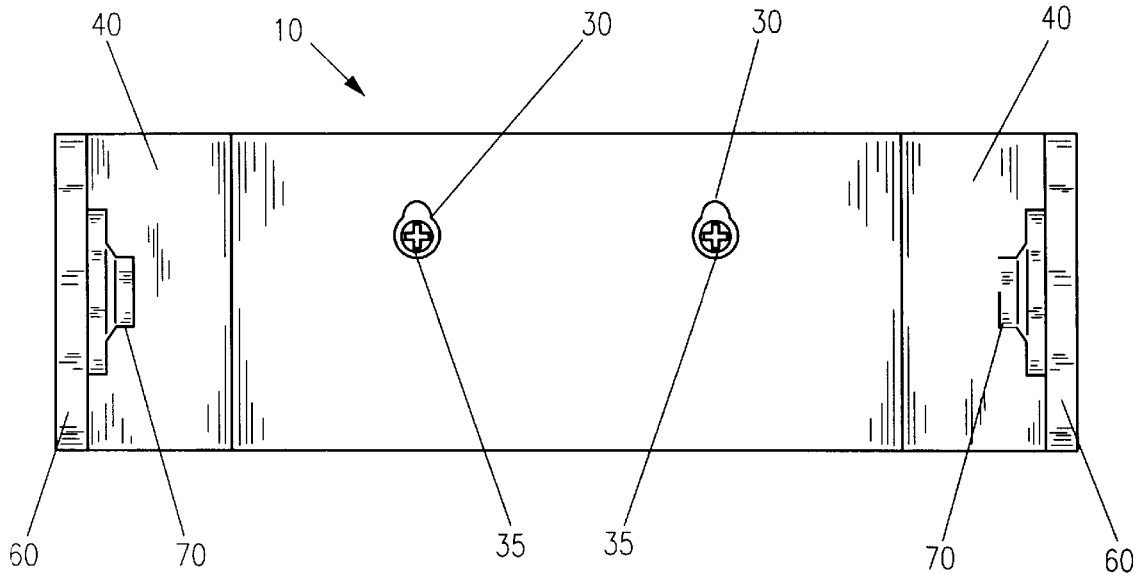
FIG. 1 is a front view of the preferred embodiment of a spring actuated, paper towel holding and dispensing apparatus.
Figure 2:
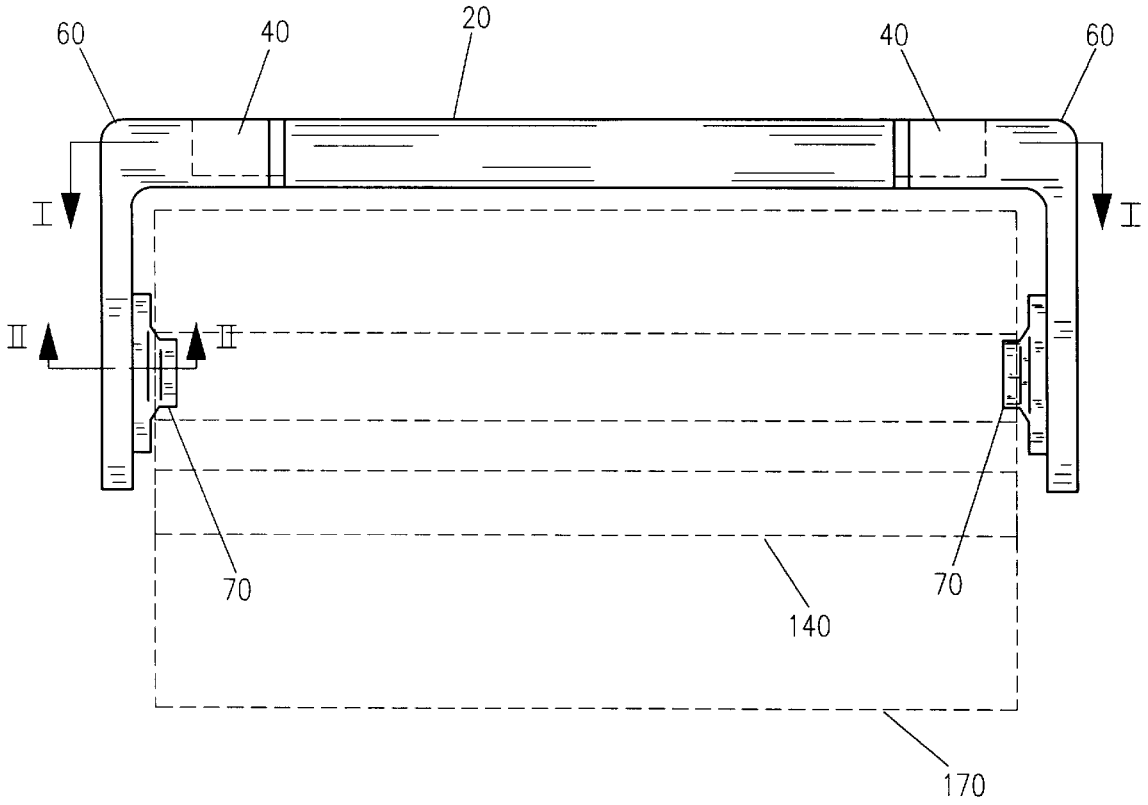
FIG. 2 is a top view of the preferred embodiment.
Figure 3:
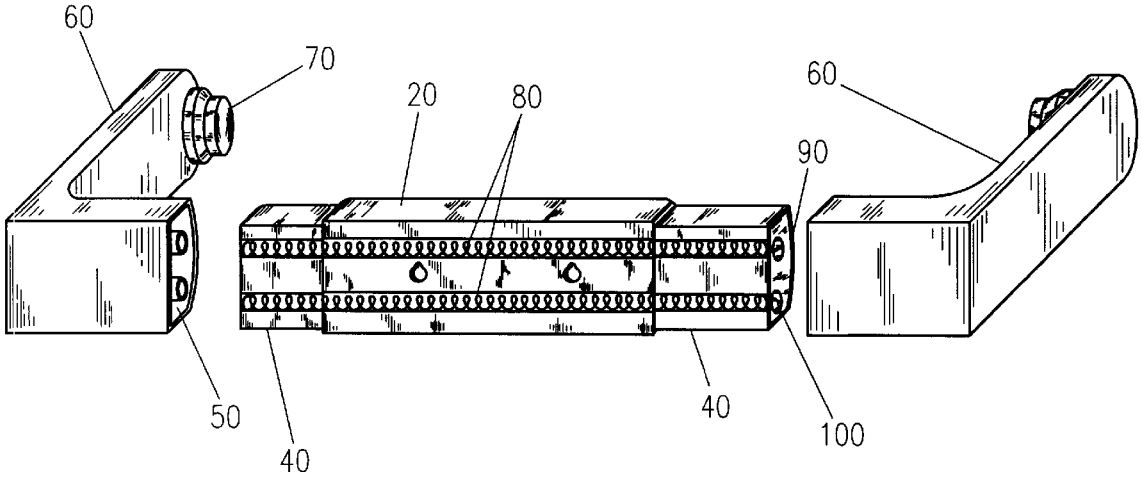
FIG. 3 is a rear perspective cross sectional view of the preferred embodiment cut along line I—I, showing a partial cutaway view of the base support.

Referring now to FIGS. 1, 2, and 3, a spring actuated, paper towel holding and dispensing apparatus 10 is shown, according to the present invention, and which consists of a base support 20. The base support 20 is longitudinally elongated, and is constructed of a durable, lightweight material, such as plastic. Positioned in lateral linear alignment on the base support 20 are two attachment holes 30, which can be used in conjunction with an attachment means 35, such as screws, to attach the present invention to a wall, underneath a cabinet, etc. The base support 20 extends outward and terminates on either end with a base support male projection 40. The base support male projections are tapered in design. Each of the two base support male projections passes into and terminates inside of a support arm receiving orifice 50. Attached to the end of each support arm receiving orifice 50 is a support arm 60. Each support arm 60 is elongated and extends outward, perpendicular to the centerline of the base support 20. Connected to the interior surface of each support arm 60, opposite the support arm receiving orifice 50, is a cylindrical shaft 70. Each cylindrical shaft 70 is mounted such that its center line is perpendicular to the interior planar surface of each support arm 60 and parallel to the centerline of the base support 20.

Referring to FIG. 3, two spring members 80 are positioned within the base support 20. The two spring members 80 extend laterally, running parallel to the center line of the base support 20, which is hollow in design. Each spring member 80 is positioned in the same plane relative to the centerline of the base support 20. Each spring member 80 passes through the center of the base support 20, being kept equidistant from each other by means of a spring member guide 90.

Figure 4:
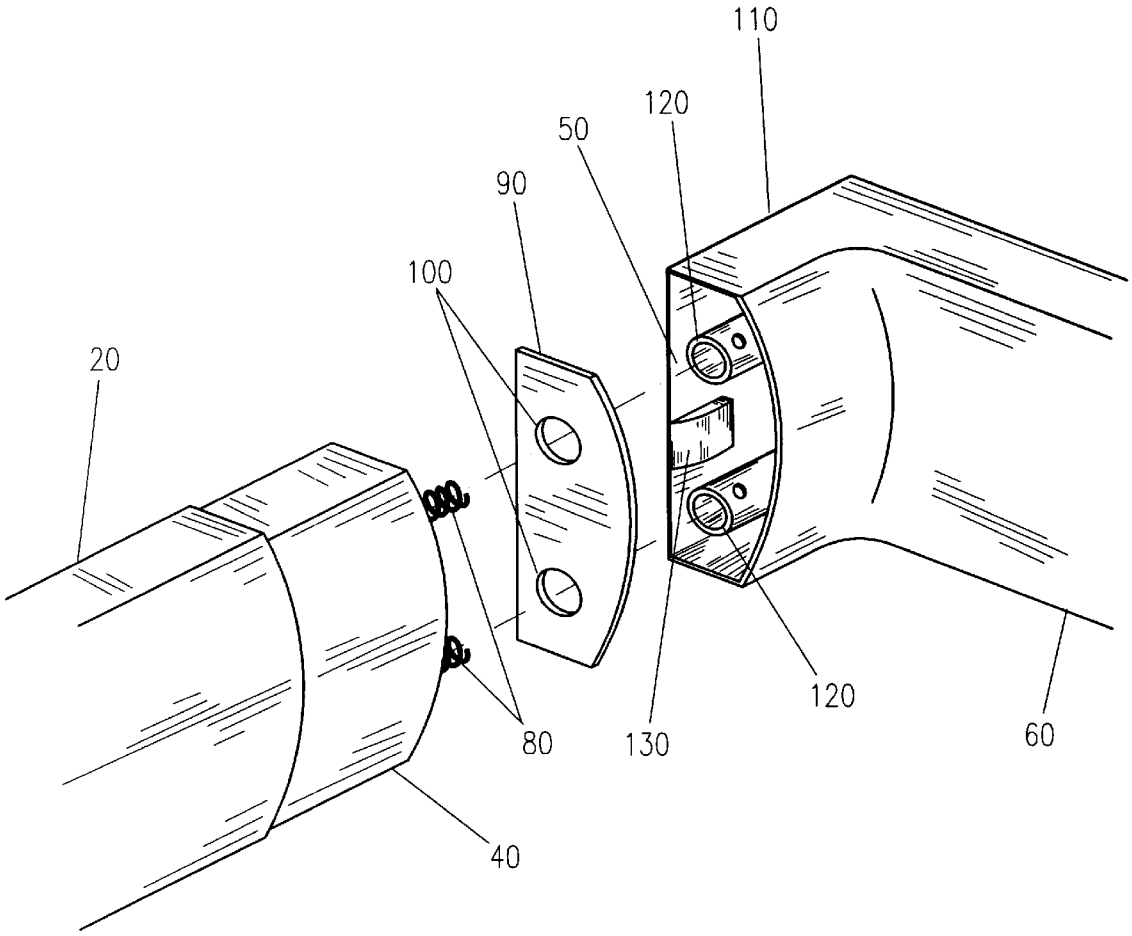
FIG. 4 is an enlarged, exploded, perspective view of the support arm and base support showing how they are connected.

Referring now to FIG. 4, the spring member guide 90 consists of two spring member guide holes 100 positioned in vertical linear alignment. The spring member guide 90 is positioned at the end of each base support male projection 40. Each spring member 80 passes through the hollow base support male projection 40 and through a spring member guide hole 100. Each spring member 80 attaches to the support arm 60 by means of a spring member retaining orifice 110, which is positioned on the exterior surface of a spring member alignment protrusion 120. The spring member alignment protrusions 120 are cylindrical in shape, and are positioned on the interior surface of the support arm receiving orifice 50, extending laterally outward, toward the base support 20. Each spring member alignment protrusion 120 is in linear alignment with the corresponding spring member 80.

When each base support male projection 40 is inserted into the corresponding support arm receiving orifice 50, each of the two spring member alignment protrusions 120 is inserted into the corresponding spring member guide hole 100. A base support retention means 130, such as a raised wedge, is positioned on the rear interior surface of the support arm receiving orifice 50. The base support retention means 130 is positioned such that it increases in thickness as its depth into the support arm receiving orifice 50 increases. Once the spring member guide 90 slides over the base support retention means 130, its lateral movement is limited such that the base support male projection 40 cannot exit from the support arm receiving orifice 50. Once the base support 20 and the support arm receiving orifice 50 are connected, the relative lateral position of each support arm 60 with respect to the base support 20 can be varied such that the lateral distance between the support arms 60 can be adjusted to fit a variety of paper towel rolls 140 of differing widths.

Figure 5:
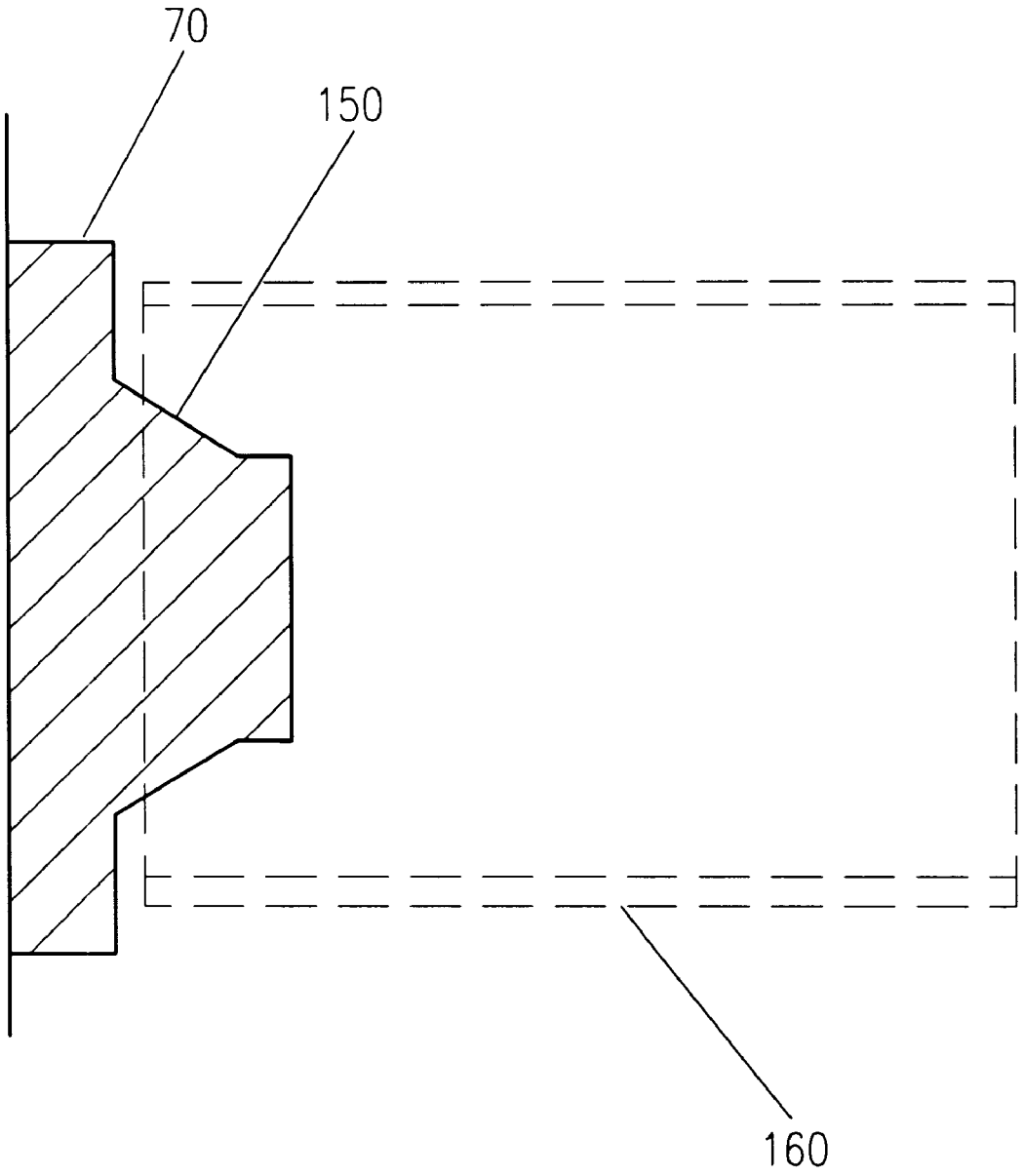
FIG. 5 is an enlarged, front, cross sectional view of the cylindrical shaft cut along line II—II.

FIG. 5 provides further detail as to the configuration of the cylindrical shaft 70. The cylindrical shaft 70 contains a flange 150 at the position where the paper towel roll cardboard core 160 contacts the cylindrical shaft 70. The flange 150 permits the cylindrical shaft 70 to come in contact primarily with the paper towel roll cardboard core 160, and not the paper towels 170 on the paper towel roll 140. This creates even tension regardless of the amount of paper towels 170 on the paper towel roll 140.

Figure 6:
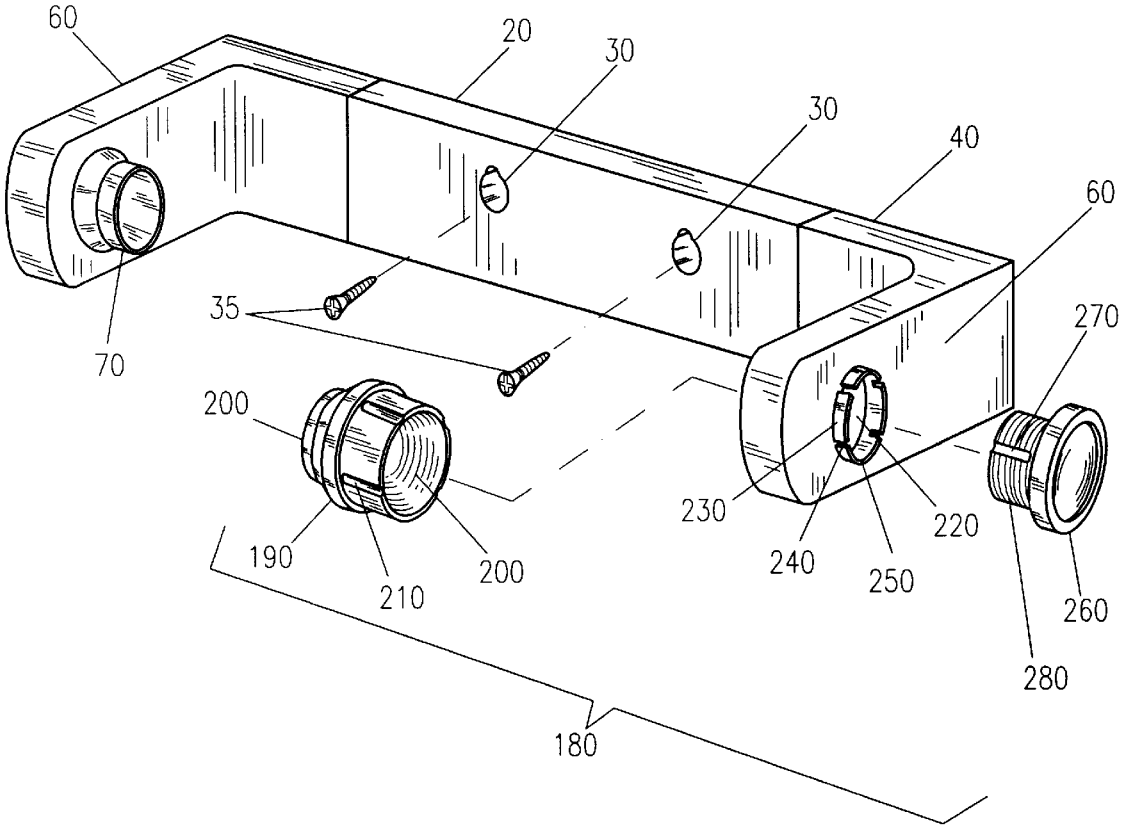
FIG. 6 is a front perspective view of the preferred embodiment shown with a modified tension adjustment assembly.
Figure 7A:
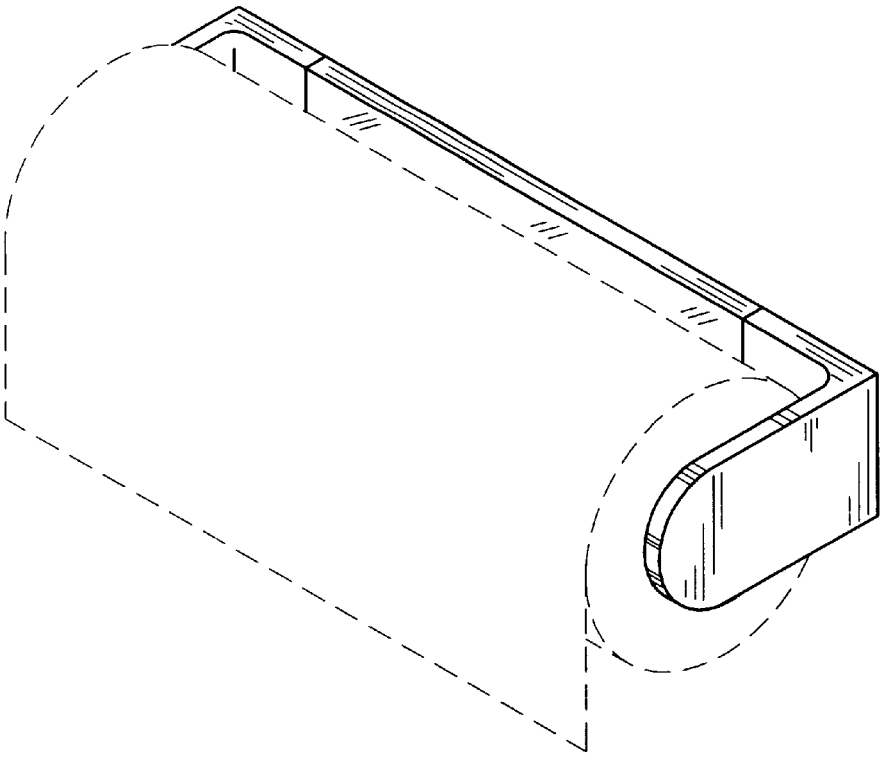
FIGS. 7*a*–7*l* are a series of perspective views of alternate embodiments of the present invention, designed for aesthetic purposes, using the same spring mechanism as the preferred embodiment.
Figure 7B:
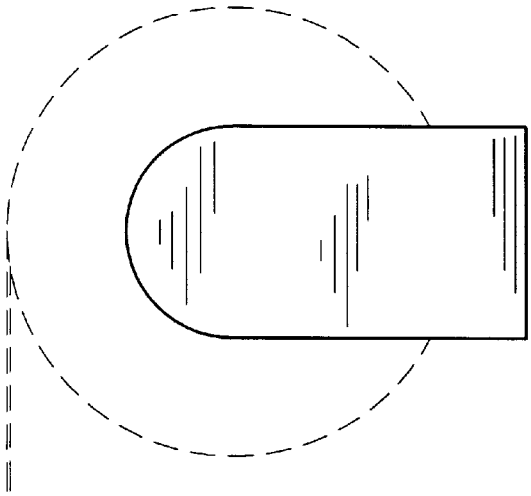
Figure 7C:
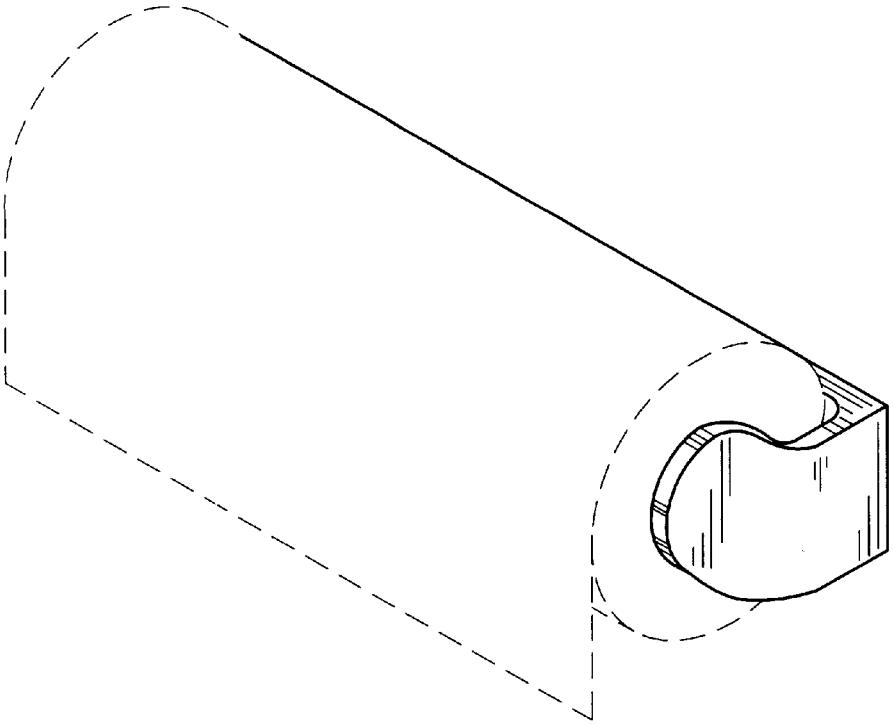
Figure 7D:
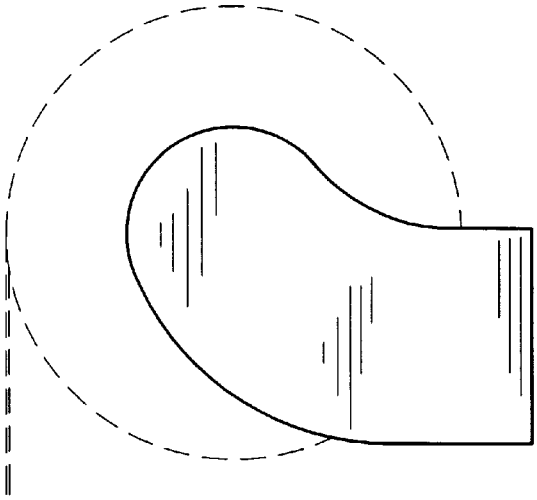
Figure 7E:
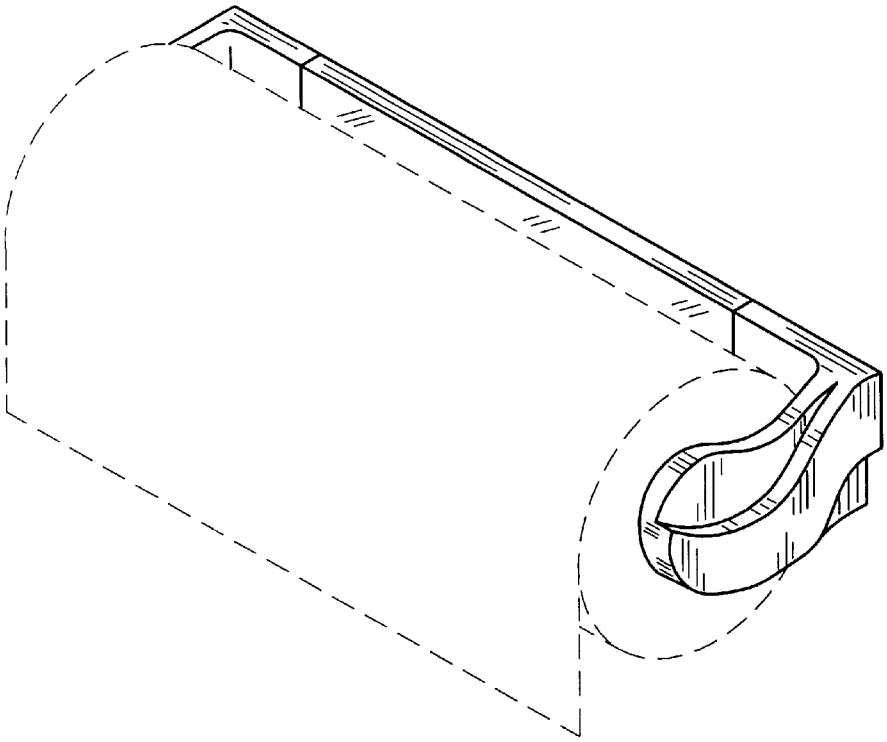
Figure 7F:
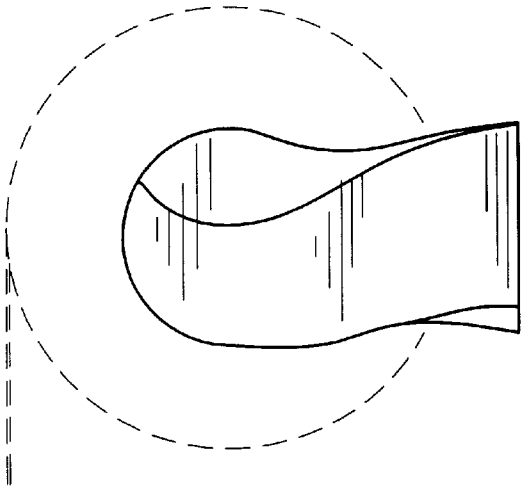
Figure 7G:
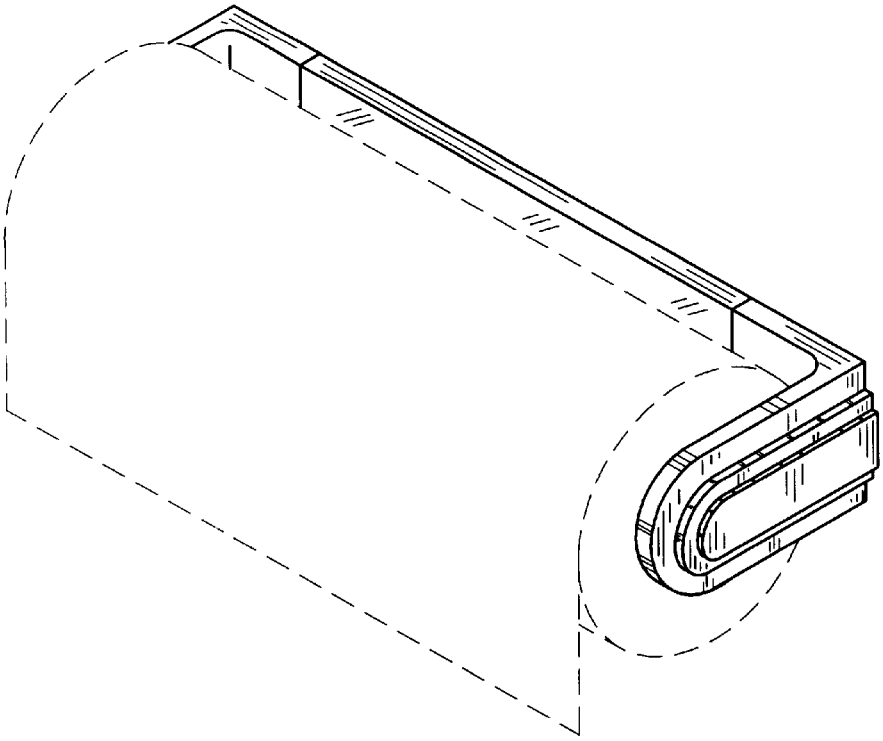
Figure 7H:
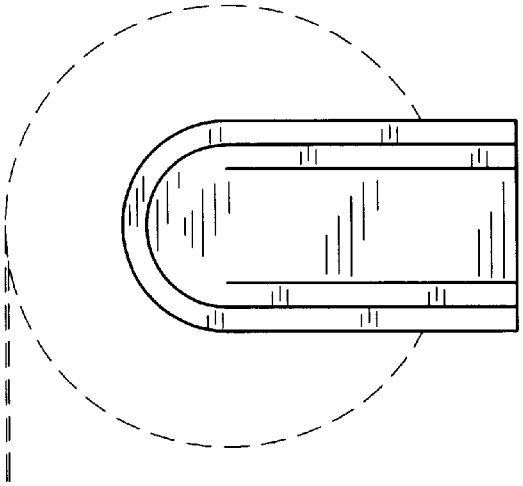
Figure 7I:
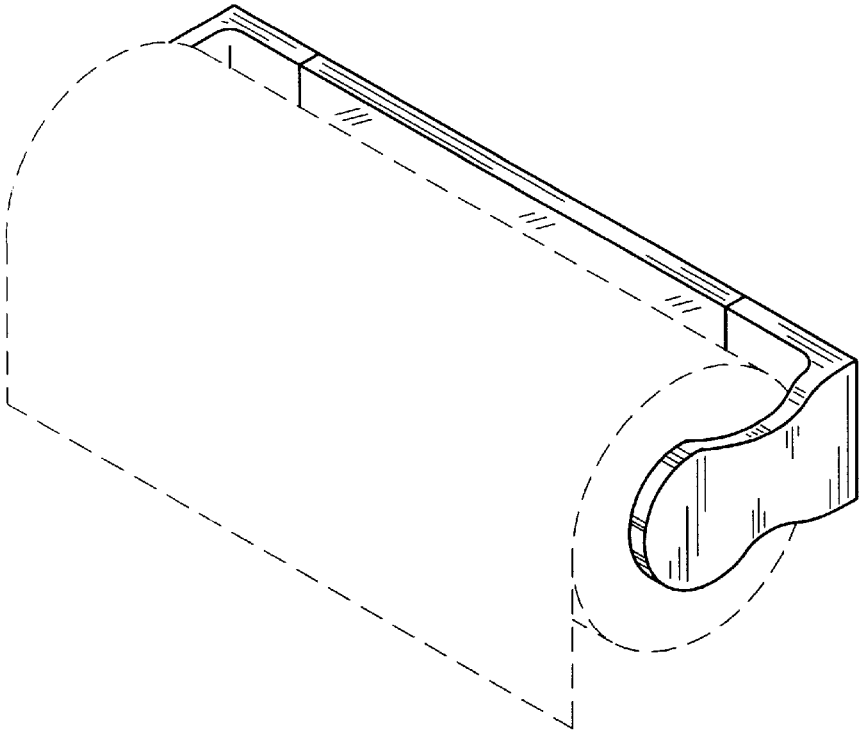
Figure 7J:
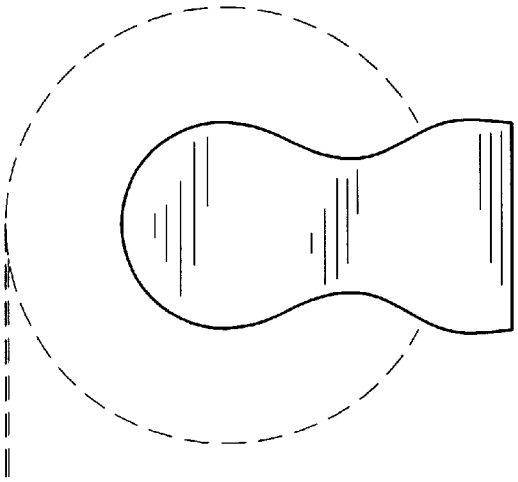
Figure 7K:
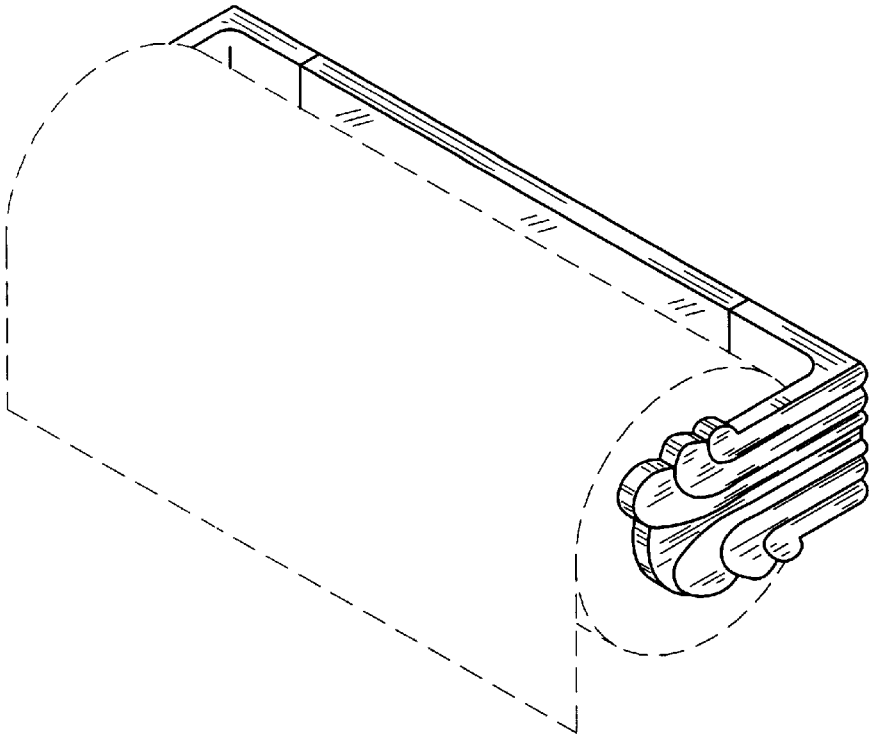
Figure 7L:
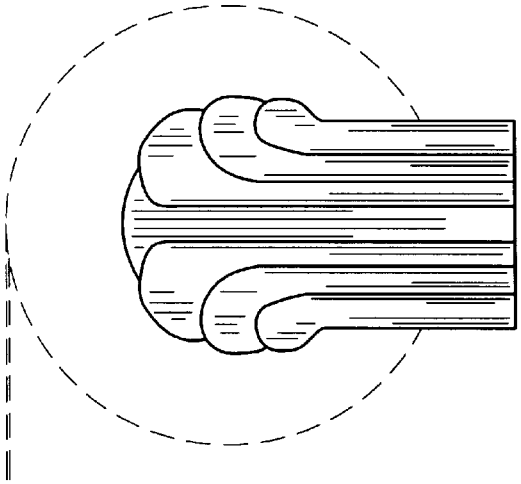

Referring now to FIG. 6, the preferred embodiment is shown with a tension adjustment assembly 180 located on each support arm 60 is used to adjust the lateral force placed upon a paper towel roll 140. The tension adjustment assembly 180 also provides better clearance for placing the paper towel roll 140 on the present invention.

Each cylindrical shaft 70 is held in place by means of a retaining ring 190. Located on the exterior surface of each cylindrical shaft 70 is a series of three cylindrical shaft retaining ridges 210, which are equidistantly located relative to the radial center of each cylindrical shaft 70.

An internal spring 290 is positioned inside of the cylindrical shaft 70. The internal spring 290 and cylindrical shaft 70 share the same axial center. The internal spring 290 provides the lateral force against the paper towel roll 140. An internal spring housing 300 is a cylindrical protrusion positioned on the outside surface of each support arm 60 and extending laterally outward. The end of the internal spring housing 300 opposite the support arm 60 terminates with an end surface consisting of a retention means hole 310 with the same axial center as the internal spring housing 300.

A retention means 320, consisting of a grasping means 330 and a retention means body 340, is used to facilitate retraction of the cylindrical shaft 70 away from the paper towel roll 140 and into the internal spring housing 300.

The retention means body is a long, cylindrical rod which extends through the retention means hole 310, the internal spring housing 300, the support arm 60, and the internal spring 290, snapping permanently into the end of the cylindrical shaft 70. The retention means hole 310 is of sufficient diameter to allow the retention means body 340 to pass through it.

The cylindrical shaft retaining ridges 210 that slide into retaining notches 240 on the internal spring housing 300 prevent rotational movement of the cylindrical shaft 70.

Referring now to FIGS. 7*a* through 7*k*, alternate embodiments of the present invention are disclosed. These alternate embodiments are for aesthetic purposes, and each uses the same spring mechanism complete with spring members 80, as the preferred embodiment of the present invention described above.

Figure 8A:
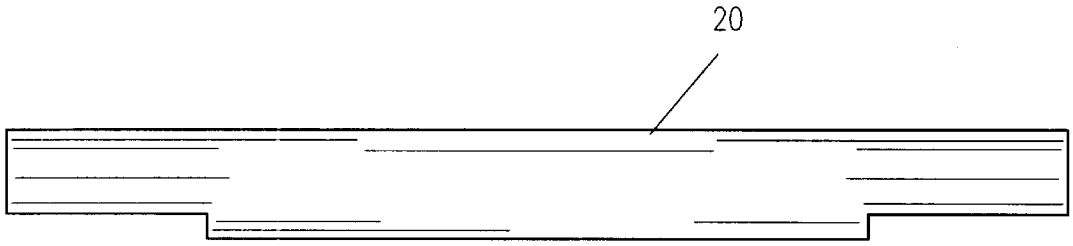
FIG. 8*a* is a rear view of an alternate design for the base support.
Figure 8B:
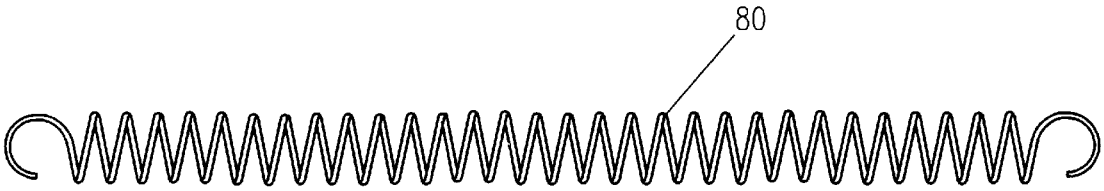
FIG. 8*b* is a side view of the spring member.
Figure 8C:
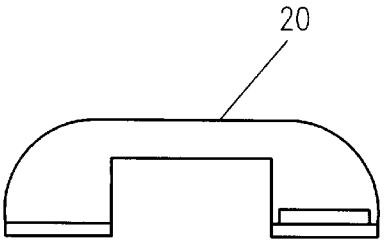
FIG. 8*c* is an end view of the base support of the alternate design of FIG. 8*a;*

Referring now to FIG. 8*a* through 8*c*, in an alternate design of the base support 20, the posterior ends of the base support 20 are curved so as to create a decorative design that is aesthetically pleasing.

Figure 9:
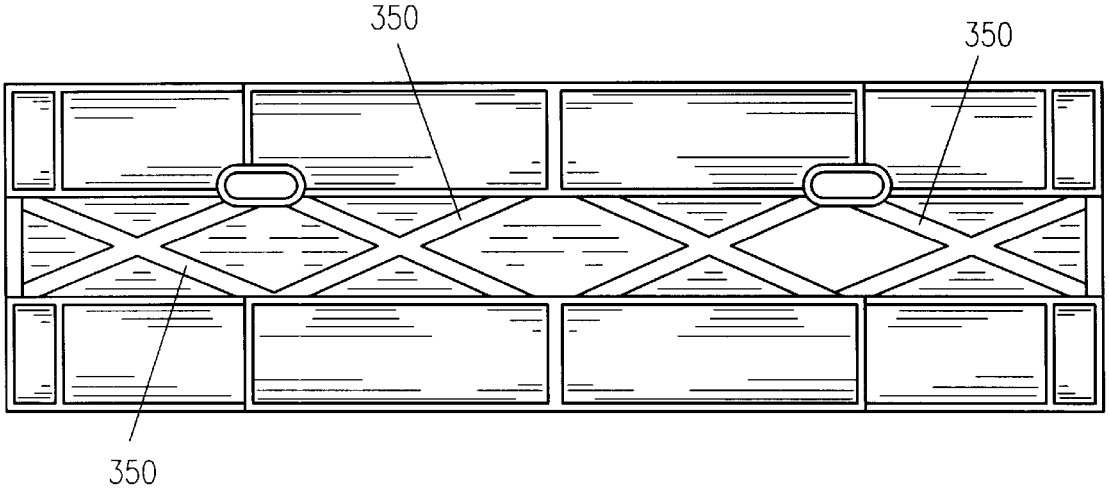
FIG. 9 is a rear view of another alternate design for the base support.

Referring now to FIG. 9, cross braces 350 are depicted inside the spring member guide 90. The cross braces 350 provides structural support for the base support 20, as force is applied to the spring member 80 during use.

Figure 10:
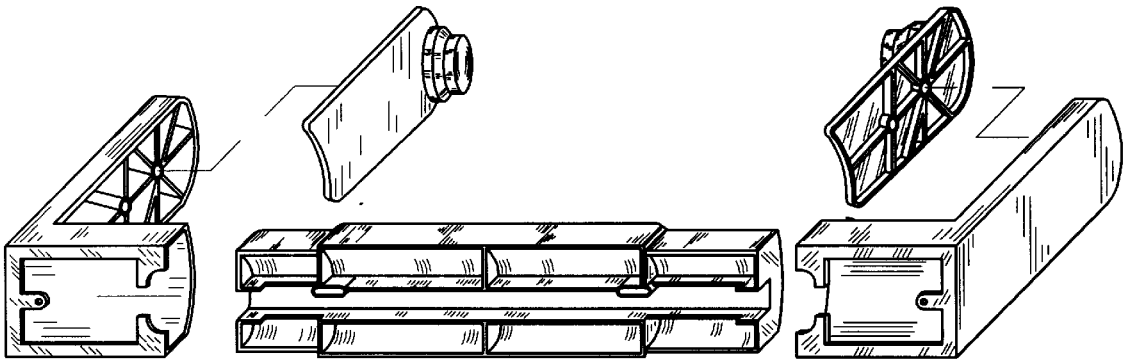
FIG. 10 is a perspective view of an alternate embodiment of the present invention.

Referring now to FIG. 10, it is envisioned that only one spring member 80 is utilized in this embodiment. The length, size and configuration of the spring member 80 is adapted to provide sufficient force for operation of the present invention. For purpose of disclosure, the spring member 80 has a length of 9.5 inches hook to hook, an outside diameter of 0.312 inches, and a wire diameter of 0.035 inches.

The alternate design removes the need for internal spring member guides 90. The one spring member guide 90 is configured as an external channel, located on and formed from the rear of the base support 20. Also, the spring member alignment protrusions 120 have been modified in size and configuration, and are now located on the inside lateral wall of the support arm receiving orifice 50.

2. Operation of the Preferred Embodiment

In accordance with a preferred embodiment of the present invention, to use the device, one separates the support arms 60 by pulling them apart. The paper towel roll 140 is then placed in between the support arms 60, and the paper towel roll cardboard core 160 is place over the cylindrical shafts 70. The separation of the two support arms 60 elongates the two spring members 80, which places sufficient, even, lateral force on the paper towel roll cardboard core 160 when the support arms 60 are released. The paper towel roll 140 will turn slowly and evenly, permitting the easy tearing of the desired number of paper towels 170, with one hand, without the paper towel roll 140 becoming disconnected from the cylindrical shafts 70.

The cylindrical shaft 70 can be retracted by pulling on the grasping means 330. This action pulls the cylindrical shaft 70 into the support arm 60 and into the internal spring housing 300. Lateral force on the paper towel roll 140 is restored by releasing the grasping means 330.

The foregoing description is included to illustrate the operation of the preferred embodiment and is not meant to limit the scope of the invention. The scope of the invention is to be limited only by the following claims.

What is claimed is:

1. A spring actuated, paper towel holding and dispensing apparatus for paper towel holders having a cardboard core, consisting of;

a base support, said base support having lateral ends and a posterior surface, and said base support being longitudinally elongated, and constructed of a durable, material;

two attachment holes, said attachment holes being positioned in lateral linear alignment on the posterior surface of said base support, said attachment holes used in conjunction with attachment means to attach the spring actuated, paper towel holding and dispensing apparatus to a wall;

two base support male projections; said base support male projections having an end, are hollow in design, and said base support male projections located at the ends of said base support;

two support arms, said support arms have an interior surface, an exterior surface and an end, and said support arms being of elongated shape and located perpendicular to the centerline of said base support, and used to hold the paper towel roll in place;

two support arm receiving orifices, said support arm receiving orifices having an interior surface, and said support arm receiving orifices being designed to allow said base support male projection to be slidably inserted therein;

two cylindrical shafts, each said cylindrical shaft having at least one end, an interior surface and an exterior surface, and said cylindrical shafts being used to hold the paper towel rolls and apply pressure to the paper towel roll;

two spring members, said spring members running inside said base support, laterally, and said spring members being used to provide the lateral tension to the paper towel roll;

two spring member guides, said spring member guides used to keep said spring members in alignment in the horizontal and vertical planes;

two spring member alignment protrusions, said spring member alignment protrusions having an exterior surface, and said spring member alignment protrusions used to keep said spring members in alignment, and used to secure said spring member to said support arm;

two spring member retaining orifices, said spring member retaining orifices located on said spring member alignment protrusions, and used to secure said spring members to said spring member alignment protrusions;

two base support retention means, said base support retention means being of wedged shape and used to limit movement of the base support male projection once inserted into said support arm receiving orifice;

two tension adjustment assemblies, said tension adjustment assemblies located on the end of each said support arm opposite said support arm receiving orifice, said tension adjustment assemblies used to provide variable resistance to the paper towel roll.

2. The tension adjustment assembly described in claim 1, wherein said tension adjustment assembly is further comprised of;

an internal spring, said internal spring being positioned inside of said cylindrical shaft, with said internal spring and said cylindrical shaft sharing the same axial center; said internal spring providing the lateral force against the paper towel roll;

an internal spring housing, said internal spring housing having at least one end, and being a cylindrical protrusion positioned on the exterior surface of each said support arm, and extending laterally outward;

retaining notches, located on the exterior surface of said internal spring housing;

a retention means, said retention means used to facilitate retraction of said cylindrical shaft away from the paper towel roll and into said internal spring housing;

a retention means hole, said retention means hole being located at the end of said internal spring housing opposite said support arm, said retention means hole having the same axial center as said internal spring housing, said retention means hole being of sufficient diameter to allow said retention means to partially pass through it;

cylindrical shaft retaining ridges, said cylindrical shaft retaining ridges located on the exterior surface of said cylindrical shaft, said cylindrical shaft retaining ridges sliding into said retaining notches on said internal spring housing, to prevent rotational movement of said cylindrical shaft.

3. The retention means described in claim 2, said retention means further comprising;

a retention means body, said retention means body being a long, cylindrical rod which extends through said retention means hole, said internal spring housing, said support arm, and said internal spring, snapping permanently into the end of said cylindrical shaft;

grasping means, said grasping means used to pulling said retention means away from said cylindrical shaft, thus releasing lateral pressure against said paper towel roll.

4. The paper towel holder described in claim 1, wherein the paper towel holder further comprises:

one spring member;

one spring member guide, said spring member guide configured as an external channel, located on and formed from the rear of said base support;

spring member alignment protrusions, said spring member alignment protrusions located on the inside lateral wall of said support arm receiving orifice; and cross braces, located inside the spring member guide, said cross braces providing structural support for said base support, as force is applied to said spring member during use.

* * * * *